US007735462B2

(12) United States Patent
Obermeier

(10) Patent No.: US 7,735,462 B2
(45) Date of Patent: Jun. 15, 2010

(54) PISTON FOR AN INTERNAL COMBUSTION ENGINE AND COMBINATION A PISTON PROVIDED WITH AN OIL INJECTION DEVICE

(75) Inventor: Karl-Heinz Obermeier, Burgbernheim (DE)

(73) Assignee: Federal-Mogul Nurnberg GmbH, Nuremberg (DE)

( * ) Notice: Subject to any disclaimer, the term of this patent is extended or adjusted under 35 U.S.C. 154(b) by 145 days.

(21) Appl. No.: 11/720,131

(22) PCT Filed: Nov. 24, 2005

(86) PCT No.: PCT/EP2005/012571

§ 371 (c)(1),
(2), (4) Date: May 24, 2007

(87) PCT Pub. No.: WO2006/056440

PCT Pub. Date: Jun. 1, 2006

(65) Prior Publication Data

US 2008/0078339 A1 Apr. 3, 2008

(30) Foreign Application Priority Data

Nov. 24, 2004 (DE) ..... 10 2004 056 769

(51) Int. Cl.
*F01P 1/04* (2006.01)

(52) U.S. Cl. ..... 123/41.35; 92/186

(58) Field of Classification Search ... 123/41.34–41.39, 123/193.6, 657, 660, 664–666; 92/186, 158, 92/159, 208, 216; 29/888.04, 888.042, 888.044, 29/888.047, 888.048

See application file for complete search history.

(56) References Cited

U.S. PATENT DOCUMENTS

| | | | | |
|---|---|---|---|---|
| 2,282,085 | A * | 5/1942 | Nichols et al. | 123/41.38 |
| 2,369,906 | A | 2/1945 | Moore | |
| 3,425,323 | A * | 2/1969 | Hill et al. | 92/186 |
| 5,081,959 | A | 1/1992 | Akiyama | |
| 5,890,416 | A | 4/1999 | Thieme et al. | |
| 6,895,905 | B2 | 5/2005 | Bontaz et al. | |

FOREIGN PATENT DOCUMENTS

| | | | |
|---|---|---|---|
| CH | 238210 | | 10/1945 |
| DE | 1002172 | | 2/1957 |
| DE | 1045164 | | 11/1958 |
| DE | 1141494 | | 12/1962 |
| DE | 3637196 | A1 * | 5/1988 |
| EP | 0074156 | | 3/1983 |
| FR | 555731 | | 7/1923 |
| JP | 60132050 | | 7/1985 |
| JP | 61144242 | A | 7/1986 |
| JP | 62168955 | | 7/1987 |
| JP | 07180605 | A | 7/1995 |

* cited by examiner

*Primary Examiner*—Noah Kamen
(74) *Attorney, Agent, or Firm*—Robert L. Stearns; Dickinson Wright, PLLC

(57) ABSTRACT

A piston for an internal combustion device, has at least one cooling channel, with at least two sections which, when seen from above, are located along the piston axis and/or on different levels in the radial direction, and/or the two or more cooling channels are provided, and at least two of the cooling channels are located on different levels along the piston axis and/or in the radial direction when seen from above, and that at least a supply and/or discharge element extends in an least parallel manner on the piston axis.

3 Claims, 3 Drawing Sheets

PISTON FOR AN INTERNAL COMBUSTION ENGINE AND COMBINATION A PISTON PROVIDED WITH AN OIL INJECTION DEVICE

FIELD OF THE INVENTION

The present invention relates to a piston for an internal combustion engine according to the preamble to claim 1 and a combination of a piston of this kind with an oil injection device.

In particular in the field of diesel engines, developments in recent years have been increasingly directed at increasing the power density. For this, above all high-speed, supercharged diesel engines are provided. The power increase results in higher temperatures at the piston and to higher mechanical stresses due to the increasing ignition pressure. In view of these increased stresses, up to now, first and foremost increased thermal resistance of the piston linings has been provided. However, in particular the use of aluminium is thermally restricted since the elements added to increase the thermal resistance, in particular nickel and copper, result in a reduction of the melting temperature. Further measures for increasing the thermal resistance of aluminium pistons consist in the introduction of reinforcements for example by remelting, alloying or the introduction of metallic or ceramic fibres or dispersion materials. It is also in principle possible to make pistons out of composite materials. The solutions known to date have the drawback of high production costs.

PRIOR ART

The invention is based on prior art in the form of a piston with a cooling channel which is known as an article of prior art. Known cooling channels can have different cross-sectional shapes and special embodiments, such as for example an undulating course.

Known from U.S. Pat. No. 5,081,959 is a piston which does not have a combustion bowl. The piston is embodied with two or more separate cooling channels which are filled through an obliquely arranged nozzle, wherein boreholes to feed oil into the cooling channels are disposed obliquely relative to the direction of the jet.

JP 61-144242 also discloses a piston with two separate cooling channels wherein two obliquely arranged nozzles for supplying oil are provided and boreholes for supplying oil into the cooling channels are disposed obliquely relative to the direction of the jet.

PRESENTATION OF THE INVENTION

The invention is based on the object of using simple means to provide a piston with an improved cooling effect and a disposal of this kind with a cooling channel.

This object is achieved with the piston described in claim 1.

According to this, according to a first embodiment, the piston according to the invention comprises a cooling channel with at least two sections, which are located at different levels height-wise along the piston axis and/or in the radial direction. According to a second embodiment, which can be combined with said first embodiment, but, like the first embodiment, can also be provided alone, the piston according to the invention comprises two or more cooling channels, of which at least two are located at different levels height-wise along the piston axis and/or in the radial direction.

The fundamental idea of the invention substantially consists in the provision of a plurality of cooling channels or interconnected cooling channel sections which extend in different zones of the piston and hence achieve efficient cooling. In particular, this enables the temperatures in the entire piston to be reduced without requiring the complex embodiments selected to date. With regard to the disposal "at different levels", it should be stated that this means a disposal one on top of another and/or a side-by-side disposal of enclosed cooling channels or cooling channel sections. In this regard, the teaching described herein differs from known cooling channels which could have an undulating course and correspondingly with which individual, relatively short sections are located at different levels. In addition, it also differs from cooling channels which could have an annular section and an inclined section branching off therefrom. Sections of this kind are not located at different levels insofar as they are directly connected to each other. In particular, cooling channels are not provided with any separate sections to the effect that they may be identified as separate openings in a sectional view containing the axis. Instead, the connection between the different sections can be identified in said sectional view.

On the other hand, it is provided according to the invention that, for example, cooling channels or cooling channel sections, which are located along the piston axis at a different (axial) level, are delimited from each other in the region of the shortest connection between two channels or sections of this kind by piston material. Nevertheless, they can also be fluidically connected to each other by a suitable, in the broadest sense helical connection. In addition, the connection between two cooling channel sections of this kind can also be formed by connecting apertures or boreholes extending extensively parallel to the piston axis. This is in particular the case when the two cooling channel sections are located at different levels only in the direction of the piston axis, but not in a radial direction.

Two cooling channels or cooling channel sections located at different levels in the radial direction, that is radially further outward or further inward, ie extending from the piston axis toward the piston skirt, can also be connected by an extensively helical connection or an extensively straight connection aperture or borehole. Since the cooling channel sections are located at radially different levels, a connection aperture or borehole of this kind would be suitably inclined in relation to the piston axis. If a cooling channel comprises at least two sections, which, as described, are located at different levels, the filling can take place in such a way that the oil is introduced into the upper channel by means of a nozzle, for example, from where it flows into the lower channel and is finally discharged.

The embodiments according to the invention enable an optimised cooling effect to be achieved with a suitable, still relatively simple design of one or more cooling channels. The cooling channels or cooling channel sections can be moved to the respective zones at particular risk from temperatures. Here, the cooling channels can ensure an advantageous reduction of the piston temperature.

Another advantage to be mentioned is that an embodiment with a plurality of cooling channels or cooling channel sections requires the piston to be changed to such a small extent that advantageously existing casting equipment can be used. For example, it is also possible to use the special casting equipment required for the incorporation of reinforcing fibres. This also means that the piston according to the invention is particularly cost effective.

At least one supply and/or discharge element extends substantially parallel to the piston axis. Preferably, all the supply and/or discharge elements are disposed parallel to the piston axis. Supply and/or discharge elements of this kind may be produced using casting cores or similar methods using conventional casting techniques. This facilitates cost-effective production. However, the production of supply and/or discharge elements subsequently by means of boreholes or similar production measures is also conceivable.

The piston is preferably made of aluminium or an aluminium alloy and is preferably installed in a diesel engine, preferably a direct injection engine. It is also possible to introduce reinforcements into the piston, for example by remelting, alloying or the incorporation of metallic or ceramic fibres or dispersion materials.

Advantageous further embodiments of the piston according to the invention are described in the other claims.

Even though individual cooling channels can be connected together with respect to the supply and/or discharge element, it has been found to be advantageous for the individual cooling channels to comprise fluidically separate supply and/or discharge elements. In the region of the supply element, this has the advantage that, as will be explained in more detail below, either the oil pressure for the respective cooling channel can be set separately or by means of an obliquely arranged nozzle, the filling may be performed through a single nozzle and simultaneously each cooling channel can be supplied separately and reliably with coolant. In the region of the discharge element, the fluidic separation has the advantage that the coolant can be discharged unimpeded and does not impede the subsequent flow of colder coolant.

Where they are provided separately, it is currently preferred for the disposal of the supply elements, that all the supply elements, in particular two supply elements in the case of the provision of two separate cooling channels, are located on the minor thrust face of the piston. The provision of a second cooling nozzle requires an additional recess on the piston shaft or it will be necessary to widen an existing recess. Under these circumstances, it has been found to be advantageous to dispose both supply elements on the minor thrust face. However, it is also conceivable, and may be preferable in certain applications, for both supply elements to be disposed on the major thrust face or for one supply element to be disposed on the major thrust face and one supply element to be disposed on the minor thrust face providing a "cruciform disposal". A "cruciform" disposal can be advantageous from a production point of view, for example.

For separate supply and/or discharge elements, it has been found to be advantageous to dispose these at different positions in the axial and/or radial direction and/or in the circumferential direction. An axial offset of this kind means that an inlet aperture for a "higher" cooling channel or cooling channel section is correspondingly located at a higher level. This enables a not always desirable tubular feed to be avoided in a higher region. A radially separate disposal of supply and/or discharge elements enables the available piston material to be used in a favourable way to form the supply and/or discharge elements. The same is applicable in the case where the supply and/or discharge elements are disposed alternatively or supplementary to the aforementioned embodiments offset in the circumferential direction.

It has been found in tests that a particularly good cooling effect can be achieved with an embodiment with which, with a piston with a combustion bowl, at least one cooling channel is provided in the region radial to the combustion bowl. In other words, this involves a cooling channel in an "upper" region relative to the piston axis in the environment of the piston head.

Optionally, supplementary to this, it has been found to be advantageous to provide at least one cooling channel in an axial region below the combustion bowl. This cooling channel can be disposed, for example, in the region below an outer edge of the combustion bowl.

The piston according to the invention may be seen as advantageous solely due to the improved cooling effect. However, there are also particularly advantageous embodiments in combination with advantageous oil injection disposals. Consequently, a combination of this kind can also be considered the subject matter of the present invention.

It is hereby preferred that the oil injection disposal comprises at least two nozzles. In this way, the nozzle in question can be adapted for the injection of coolant, in particular oil, into the respective cooling channel.

Advantages from a production point of view are obtained if the nozzles are provided on opposing sides.

In this context, it is currently preferable for the nozzle which is provided for the injection of coolant into a cooling channel in the region of the piston head, to generate a higher oil pressure than the other nozzles. This enables, in an advantageous way, the amount of coolant, in particular oil, to be reduced.

As an alternative to the embodiment described above, it is however, conceivable for the piston to be combined with an oil injection disposal with a single nozzle. This results in a particularly simple design.

In order nevertheless, to achieve separate filling of two or more cooling channels, a preferred embodiment consists in the fact that the one nozzle provided comprises two or more discharge channels.

As an alternative to this, a simpler design can be achieved in that a single nozzle is disposed obliquely so that the jet of coolant extends obliquely so that, depending upon the position of the piston, said jet enters one or more different cooling channels. The oblique disposal of a jet of coolant enables the coolant, for example in different positions of the piston between the upper and lower dead centre, ie in the direction of the piston axis, to enter different supply apertures located in different positions in the radial direction and/or in the circumferential direction. In other words, in different positions of the piston, different cooling channels can be filled. As an alternative to this, it is conceivable for the jet of coolant to enter a cooling channel in one position only, for example the lower dead centre and in another position, for example at the upper dead centre, for the jet of coolant to arrive at the piston head and cool it. A second cooling channel can be filled by its own nozzle.

BRIEF DESCRIPTION OF THE DRAWINGS

The following explains an embodiment of the invention shown in the figures. These show.

DETAILED DESCRIPTION OF A PREFERRED EMBODIMENT OF THE INVENTION

Figure 1:
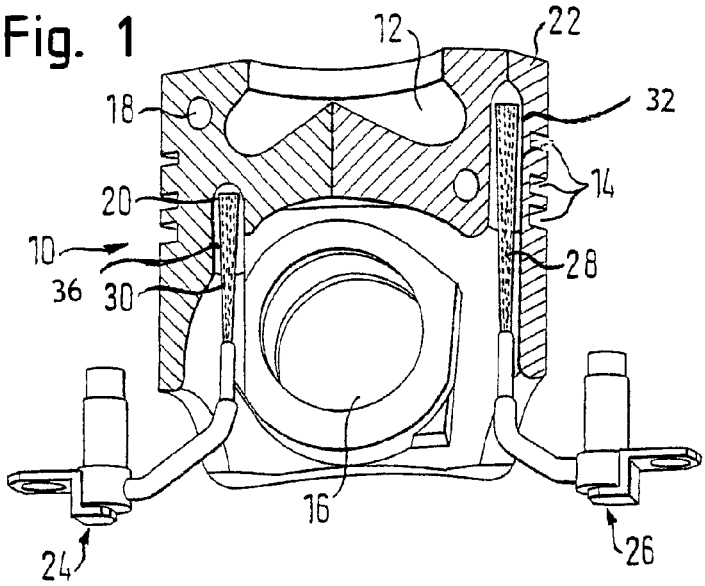
FIG. 1 a sectional view of the piston according to the invention with an oil injection disposal FIG. 2 a representation of the inner embodiment of the piston according to the invention FIG. 3 the combination shown in FIG. 1 viewed from below FIG. 4 a sectional view of a second embodiment of the piston according to the invention with an oil injection nozzle, FIG. 5 a further sectional view of the piston shown in FIG. 4.

As shown in FIG. 1, the piston 10 according to the invention, which can be made of aluminium or an aluminium alloy and in particular cast, comprises in general a combustion bowl 12, which can be ω-shaped, a plurality of annular grooves 14 and two (only one is visible) piston-pin bosses 16. The embodiment of the piston according to the invention shown comprises along the (not shown) piston axis, which according to FIG. 1 extends in the vertical direction, two cooling channels 18, 20. As shown in FIG. 1, the cooling channels can have an extensively circular cross section. A first cooling channel 18 is located in a region "next" to the combustion bowl and in the axial direction at a relatively high level, in particular a short piece below the piston head 22. Insofar, it will be referred to as the head cooling channel 18 in the following.

According to the invention, a second cooling channel 20 is provided at a level below the combustion bowl 12 and the head cooling channel 18. This cooling channel will be referred to as the bowl cooling channel 20. As mentioned, it is not only located at a lower level height-wise in the direction of the piston axis, but is also disposed at a further inward position in the radial direction. At this position, this bowl cooling channel 20 can ensure particularly efficient cooling of the hot zones between the combustion bowl 12 and the piston-pin boss 16.

The cooling channels 18, 20 are embodied with supply elements 32, 36 to supply coolant. The supply elements 32, 36 extend substantially parallel to the axis of the piston 10.

Figure 6:
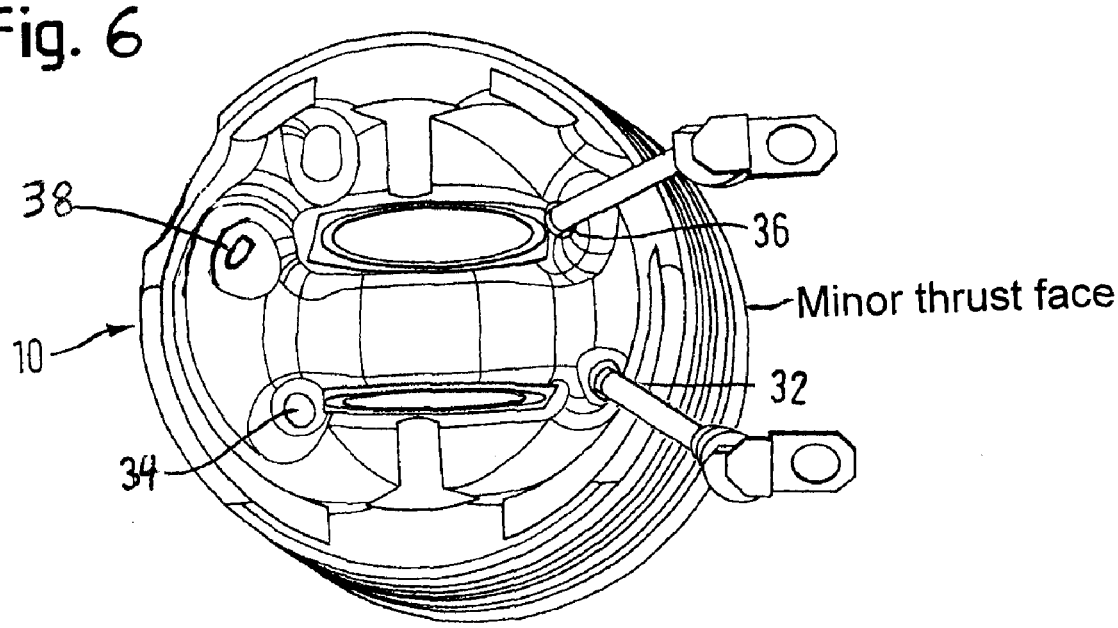
FIG. 6 is a view like FIG. 3, but of an alternative embodiment.

As shown in FIG. 1, with the embodiment shown, the supply of coolant, in particular cooling oil, takes place through two separate nozzles 24, 26. With the embodiment shown, the two nozzles are dispose don opposing sides of the (not shown) piston pin, which is mounted in the piston-pin boss 16. They are therefore disposed on the major and minor thrust faces, even though for other applications the disposal of the two nozzles on the minor thrust face is currently preferred as illustrated in FIG. 6. As shown in FIG. 1, the two nozzles generate a jet of coolant 28 or 30 with an approximately vertical direction, which enters the respective supply element 32, 36 of the cooling channel 18 or 20. As shown and explained in more detail in the following, a discharge aperture is provided in an approximately opposing position in each case.

Figure 2:
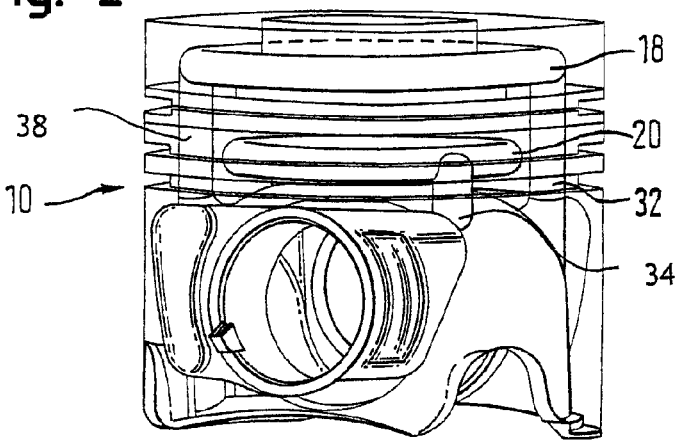

FIG. 2 also shows the interior of the piston 10 shown in FIG. 1. With the embodiment shown, the two cooling channels 18 or 20 are annular and located on a constant level. Hereby, the cross section also does not change. However, it could also have a variable, in particular undulating, design. FIG. 2 shows particularly clearly that the bowl cooling channel 20 is provided not only on a lower level, but also radially inside the head cooling channel 18. This ensures that sufficient space is provided for the supply element 32 of the head cooling channel 18. As clearly shown in FIG. 2, both the supply elements 32, 36 and the discharge elements 34, 38 are oriented substantially parallel to the piston axis.

Figure 3:
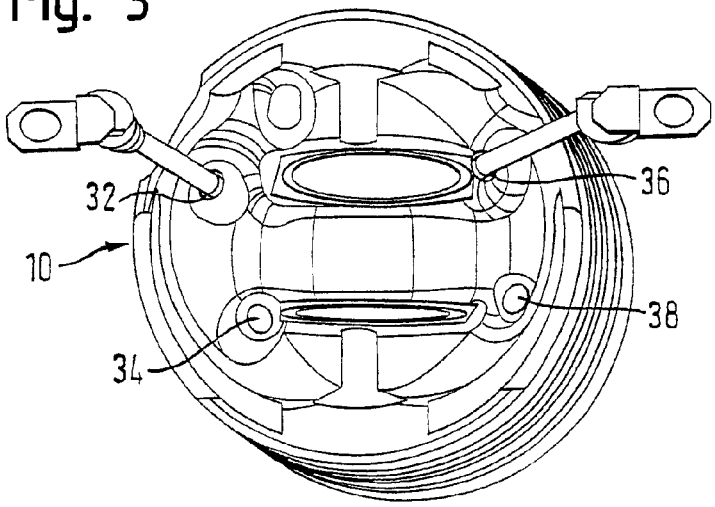

Supplementary to the details shown previously, FIG. 3 shows both discharge apertures. With the embodiment shown, the aperture for the discharge element 34 for the radial internal bowl cooling channel is located opposite the supply element 36. The same applies to the discharge element 38 for the head cooling channel 18, which is located opposite its supply element 32.

Figure 4:
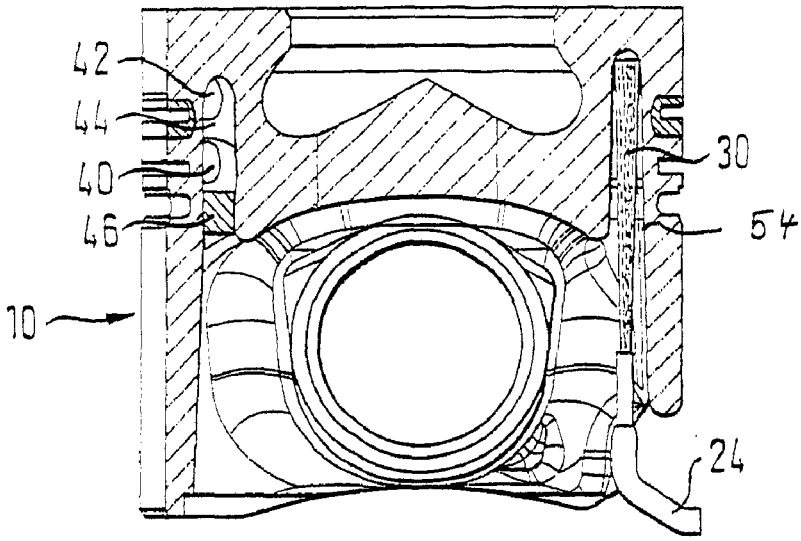

FIG. 4 is a sectional view of a second embodiment of the piston 10 according to the invention, with which two cooling channel sections 40, 42 are provided, which are located at different levels height-wise along the piston axis. On the other hand, with the embodiment shown, they are at the same level in the radial direction. Unlike the case with separate cooling channels, such as those shown in the first embodiment, these are cooling channel sections 40, 42, because with the second embodiment a connection 44 is provided. This connection substantially comprises a connection channel extending approximately parallel to the piston axis, which could also be described as a borehole. As shown on the right-hand side of FIG. 4, a nozzle 24 is provided which supplies a jet of coolant 30 in the region of the upper cooling channel section 42. To ensure that the jet of coolant 30 can, as it were, pass "through" the lower cooling channel section 40 into the upper cooling channel section 42, a borehole or a connection 52 extending approximately parallel to the piston axis is provided between these sections. The connection 52 and the supply element 54 extend substantially parallel to the piston axis. The injected oil flows through the upper cooling channel 42 and passes through the connection 44, which with the embodiment shown is provided approximately opposite to the supply element aperture, into the lower cooling channel. The connection of the lower cooling channel 40 to the lower side is sealed by a stopper 46, so that the coolant flows through the lower cooling channel section 40 and cools the surrounding regions of the piston. The coolant outlet is in the vicinity of the inlet.

Figure 5:
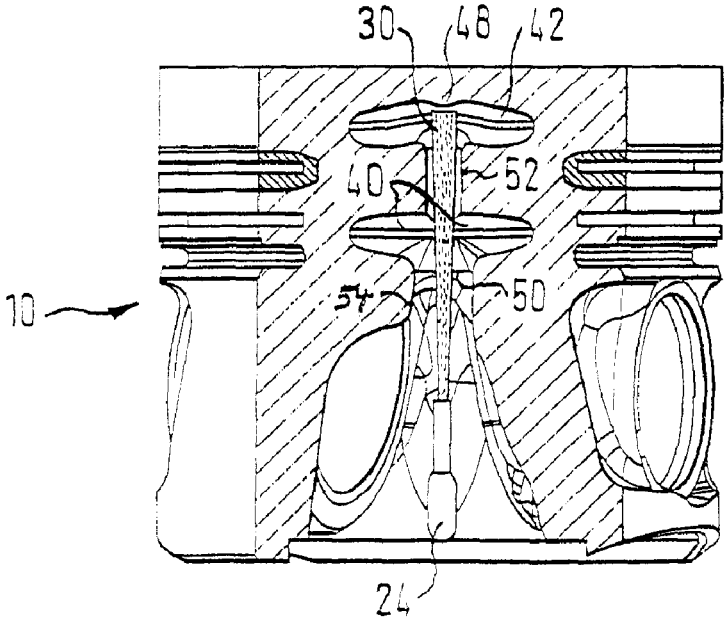

This is also shown in FIG. 5. FIG. 5 shows a section of the piston 10 in FIG. 4 in the region of the coolant inlet. As shown, the jet of coolant 30 goes as far as the region of the upper cooling channel section 42. With the embodiment shown, at the place where the jet of coolant 30 arrives at the upper limit of the cooling channel section 42 a type of elevation or rib 48 is provided to divide the jet of coolant 30 into the left and right halves of the cooling channel section 42 according to FIG. 5. At the opposing side, as shown in FIG. 4, the coolant passes through the aperture 44 into the lower cooling channel section 40 and, as shown in FIG. 5, can emerge in the environment of the coolant inlet through an aperture 50 provided on the underside of the coolant section 40 which is wider than the connection 52.

The invention claimed is:

1. A piston and coolant injection assembly comprising a piston having at least two individual cooling channels located at different levels with respect to at least one of either the height along a longitudinal axis of said piston or in the radial direction of said piston; wherein said cooling channels define flow paths for cooling fluid which are isolated from one another, and further including fluid supply and fluid discharge ports of the respective channels which are isolated from one another at different locations; with a coolant injection arrangement, wherein said coolant injection and arrangement has at least two nozzles communicating with said fluid supply ports.

2. The assembly according to claim 1, wherein said nozzles are provided on opposite sides of said piston.

3. The assembly according to claim 2, wherein one of said nozzles produces a higher oil pressure than the other of said nozzles.

* * * * *